United States Patent [19]

Brockhaus

[11] Patent Number: 4,536,918

[45] Date of Patent: Aug. 27, 1985

[54] TORSION BAR VEHICLE DOOR HINGE ASSEMBLY WITH HOLD OPEN MECHANISM

[75] Inventor: Ernst Brockhaus, Remscheid-Hasten, Fed. Rep. of Germany

[73] Assignee: Ed. Scharwächter GmbH & Co. KG, Remscheid, Fed. Rep. of Germany

[21] Appl. No.: 521,714

[22] Filed: Aug. 9, 1983

[30] Foreign Application Priority Data

Aug. 10, 1982 [DE] Fed. Rep. of Germany ..... 3229766

[51] Int. Cl.[3] ..... E05D 11/10

[52] U.S. Cl. ..... 16/308; 16/332; 16/335

[58] Field of Search ..... 16/308, 337, 341, 354, 16/376, 332, 335

[56] References Cited

U.S. PATENT DOCUMENTS 3,370,317 2/1968 Marchione ..... 16/308
4,285,098 8/1981 Hicks et al. ..... 16/308

FOREIGN PATENT DOCUMENTS 1265296 3/1972 United Kingdom ..... 16/308

*Primary Examiner*—Fred A. Silverberg
*Attorney, Agent, or Firm*—Toren, McGeady, Stanger, Goldberg & Kiel

[57] ABSTRACT

A door hinge assembly combined with a door holding device particularly for motor vehicles has a first and a second hinge member mounting the door for swinging movement between an open and a closed position, a torsion bar spring supported at one of the hinge members and having a load arm projecting over the height of the hinge member and directed parallel to the hinge axis and a pair of abutment rollers rotatively displaced against a spring disc which acts as a brake at the other of the hinge members located a distance from the hinge axis. The abutment rollers operate in cooperation with the load arm of the torsion bar to form a catch device for holding the door at least in the open position and the abutment rollers are formed with different diameters along their circumference and they are rotatably mounted about bearing axes, respectively, which are arranged spaced a distance from each other, which distance is less than the dimension of the larger diameter.

11 Claims, 4 Drawing Figures

TORSION BAR VEHICLE DOOR HINGE ASSEMBLY WITH HOLD OPEN MECHANISM

The present invention is directed toward a door hinge assembly particularly useful for motor vehicles and more specifically to a hinge assembly which includes a door fastening or holding device whereby the door may be held at least in the open position.

Devices of the type to which the present invention relates may be composed of a torsion bar spring supported at one of two hinge members, with the torsion bar spring having a load arm which projects over the height of the hinge assembly and which is directed parallel to the hinge axis with a pair of rotatably supported abutment rollers being mounted at the other hinge member. The rollers are located a distance from the hinge axis and form a catch or lock which operates in cooperation with the load arm of the torsion bar spring at least for the open position of the door.

In door fastening devices of the type discussed above known from the prior art which are structurally combined with a door hinge, such as a device known from Italian Pat. No. 728 110, the abutment rollers are arranged a substantial distance from each other so that there exists considerable play between the load arm of the torsion bar spring and the second abutment roller, the load arm being immediately engaged in each instance with only one of the two abutment rollers. When the door is open, the load arm of the torsion bar spring first engages with the first of the two abutment rollers in the proximity of the open position so as to be engaged or held and it is extended out by a certain amount by the first abutment roller thereby to brake the swinging movement of the door during opening until the load arm finally engages with the second abutment roller after a partial revolution of the first abutment roller and becomes fixed between the two rollers. Since in the type of door fastener devices known from the prior art, the abutment rollers are rotatably displaced at the other hinge member and located a distance from one another which exceeds their own diameters, considerable play results between the two abutment rollers during operative cooperation with the load arm of the torsion bar spring inasmuch as a certain freedom of movement will first result for the door which itself is caught or locked in the selected open position. Moreover, the possibility occurs that the load arm of the torsion bar spring will strike a tooth of the second abutment roller and when striking the latter, will not engage securely. This in turn may result in that the door will turn or run outwardly from the open position beyond the desired location by a certain angular amount. This may occur in the open position or in the closing position of the door. When the door runs beyond the open position which is to be secured, damage to the door can result for example when a motor vehicle is parked in a garage and the door strikes against the garage wall or another vehicle as a result of its excessive swinging movement. Such a situation will, of course, create problems when parking in a location under limited space conditions. Moreover, pendulum-like movements of the door in the open position which is to be secured are, in general, undesirable.

The invention is therefore directed toward providing an arrangement of abutment rollers in a door fastener which is structurally combined with a door hinge for motor vehicles wherein there may be securely excluded undesirable pendulum-like movements of the door in the open position which is to be secured and which furthermore necessarily avoids faulty mounting of the abutment rollers with a cost which is at least as low as in conventional structures for door fasteners of the type described.

SUMMARY OF THE INVENTION

Briefly, the present invention may be described as a door hinge assembly for a motor vehicle including means for holding a door in position comprising a first and a second hinge member mounted relative to each other for pivotal motion about a hinge axis to mount a door for swinging movement between an open and a closed position, a torsion bar spring supported at one of said hinge members, said torsion bar spring having a load arm projecting over the height of said hinge assembly and directed parallel to said hinge axis, and a pair of abutment rollers rotatably displaced against a spring disc which acts as a brake at the other of said hinge members at a distance from said hinge axis, said abutment rollers operating in cooperation with said load arm of said torsion bar spring to form a catch device at least for said open position of said door, said abutment rollers having different diameters along their circumference and being rotatably mounted about bearing axes, respectively, which are arranged spaced a distance from each other, which distance is less than the dimension of the larger diameter.

Accordingly, the objectives of the invention are met in that the abutment rollers are formed with different diameters along different parts of their circumferences and that the bearing axes of the abutment rollers are arranged spaced apart a distance which is less than the dimension of the larger diameter of the abutment rollers thereby taking into account a certain play. The abutment rollers have a circumferential toothing along one part of their circumference, particularly along half the length of their outer circumference, and they have a smooth circumferential surface along the remaining portion of the circumference. Moreover, in the area of the smooth circumferential portion, the rollers are formed with the smaller diameter.

The circumferential toothing of the abutment rollers may be configured with an undulating or wave-shaped configuration and may be adapted to the diameter of the load arm of the torsion bar spring.

Since the abutment rollers have a diameter over their toothed circumferential surface which is dimensioned to be greater than the distance between the bearing axes of the rollers, the rollers cannot undergo opposed rotational movement so that their toothed circumferential areas would engage with one another. As a result of this, incorrect mounting of the abutment rollers is prevented even should careless handling occur. Furthermore, it is not necessary to be concerned with the relative positions of the circumferentially toothed sections of the rollers when mounting the rollers since, if the load arm of the torsion bar spring should strike a tooth of one of the abutment rollers during the initial opening movement of the door, the load arm would first overrun this roller and during closing movement of the door, that is, during its return movement with reference to the abutment rollers, it would necessarily insert itself into a tooth space or gap of the first abutment roller and remain in this space or gap since the abutment rollers are braked in the usual way with the aid of the spring disc. Relative alignment of the abutment rollers thus automatically occurs upon a first or initial opening and closing operation of the door. Moreover, subsequent relative changes of position of the abutment rollers relative to one another is prevented since opposed rotational movement of the rollers is blocked by means of their circumferentially toothed sections which have a diameter larger than the distance between the respective axes of the rollers.

In accordance with a further, more specific, embodiment of the invention, the abutment rollers may be offset in a stepwise manner along the axial direction thereof and the abutment rollers may be reciprocally provided from one axial end to the other with circumferential toothing extending along a part of the circumference, the rollers having a diameter in their toothed circumferential area which is again larger than the diameter in the circumferential area which is not toothed. The abutment rollers are arranged in such a manner that a lower partial circumferential toothing having a greater diameter of one abutment roller is located opposite an upper partial circumferential toothing with a likewise greater diameter of the other abutment roller. Therefore, both abutment rollers have a diameter in their respective offset areas which is reduced relative to the toothed circumferential sections thereof. Both abutment rollers are provided with smooth circumferential surfaces in the area of their circumferential sections having a reduced diameter.

Independently of the specific embodiment selected, it is provided that the two abutment rollers have the same diameter relations.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described specific embodiments of the invention.

DETAILED DESCRIPTION OF THE PREFERRED EMBODIMENTS

Figure 1:
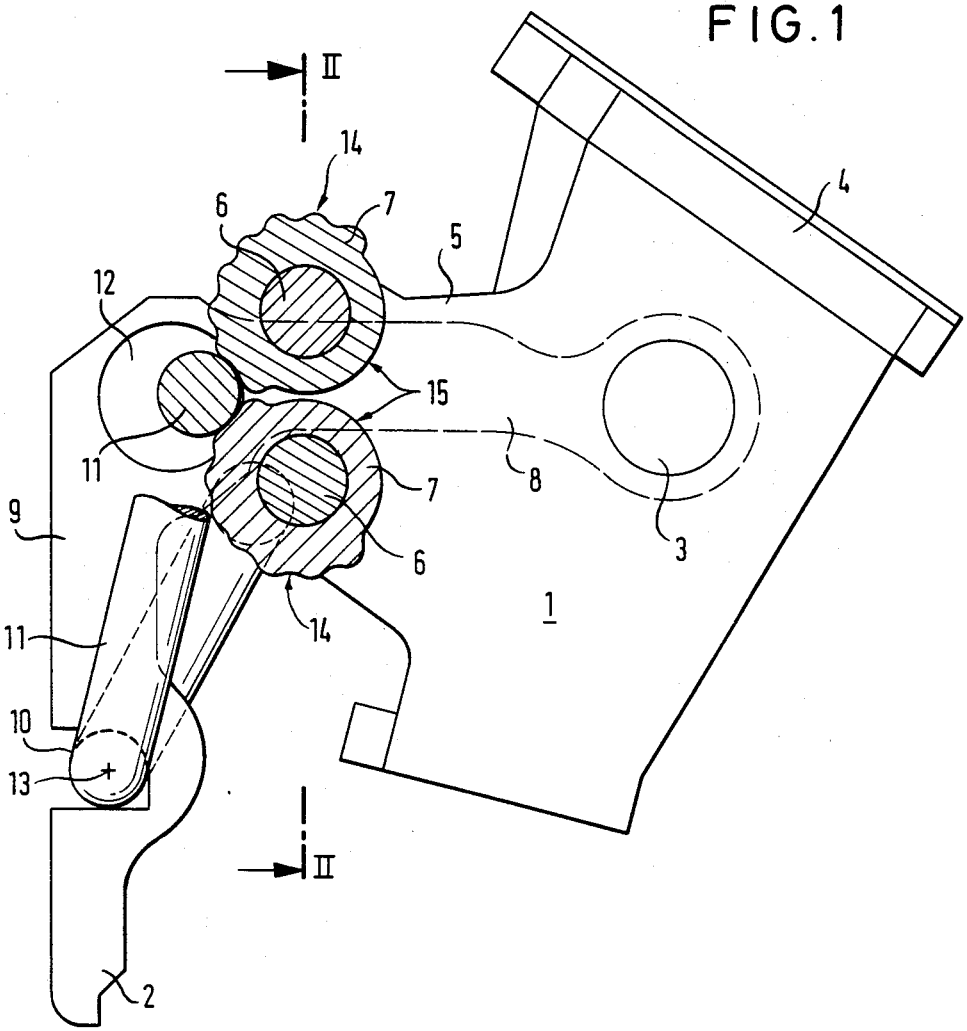
FIG. 1 is a top view of a door hinge assembly in accordance with the invention.
Figure 2:
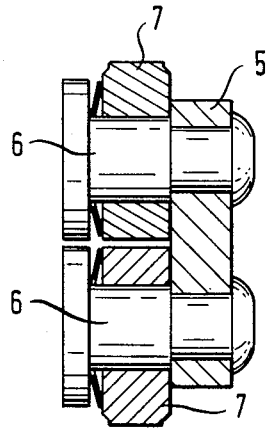
FIG. 2 is a partial sectional view taken along the line II—II of FIG. 1.

Referring now to the drawings, and particularly to FIGS. 1 and 2 wherein a first embodiment of the invention is depicted, there is shown a hinge assembly for a motor vehicle door which is composed of a first hinge member 1 which may be fastened on a door arrangement part (not shown) and a second hinge member 2 fastened at the other door arrangement part (also not shown). It will be obvious that either one of the members 1, 2 may be fastened to a door while the other member is fastened to a door frame in order to permit swinging movement of the door between an opened and a closed position.

The members 1 and 2 are pivotally attached relative to each other by a hinge pin 3. The member 1 is formed with an extension piece 5 which is arranged approximately transversely relative to a stop base 4 of the member 1, and abutment rollers 7 are rotatably mounted at the extension piece 5 for rotation about bearing axes 6.

The other hinge member 2 is formed with an approximately L-shaped sectional configuration and it is rotatably supported at the hinge member 1 by means of a side or leg 8 which is connected to the hinge pin 3. The other side or section 9 of the member 2 operates to enable mounting thereof at a door arrangement part.

A torsion bar spring 10 is supported with its shaft portion in a manner known, per se, at the hinge member 2 and a load arm 11 of the torsion spring 10 projects upwardly over the one hinge member 1 and is guided so as to swivel in a recess 12 of the hinge member 2 around an axis 13 of the shaft of the torsion bar spring 10.

In the embodiment depicted in FIGS. 1 and 2, the abutment rollers 7 are constructed identically along their entire axial length or height and they have different diameters along different portions of their circumference. The bearing axes 6 of the abutment rollers 7 are arranged spaced a distance apart from one another less than the dimension of the largest diameter of the abutment rollers 7. The abutment rollers 7 are provided with circumferential teeth 14 along a portion of their circumference, and in the specific embodiment depicted over half of their circumference. In the area of the toothed circumferential section 14, the rollers 7 have a diameter which is dimensioned to be greater than the diameter of the circumferential portion 15 of the rollers 7 over which no teeth are formed. The circumferential teeth of the abutment rollers 7 are, as will be seen from the drawings, constructed in an undulating or wave-shaped configuration and this configuration is adapted to the diameter of the load arm 11 of the torsion bar 10.

Since the spacing between the axes of the two abutment rollers 7 is smaller than their largest diametral dimension in the area of the circumferential toothing, the two abutment rollers 7 are thus arranged so that they cannot be mounted incorrectly. Furthermore, an opposed or double movement of the two abutment rollers 7 is excluded since their two circumferentially toothed sections 14 would block such movement. Therefore, it will be apparent that the abutment rollers 7 can move only within limited angular displacements.

The circumferential areas 15 of the abutment rollers 7 over which no teeth are provided and which have the smaller diameters, are constructed with a smooth exterior and are arranged in such a manner that during mounting of the rollers 7, the position of the rollers need not be exactly fixed. Thus, the position of the two abutment rollers 7 results automatically during the first and closing of the door. Specifically, if the load arm 11 of the torsion bar 10 should strike a tooth of the front abutment roller 7 during a first opening of the door, the load arm 11 will overrun the abutment roller 7 and will engage in a tooth space of the roller 7 during a subsequent closing of the door and remain in this position, since the abutment roller 7 is braked in a manner known to those skilled in the art by means of the spring disc. For all subsequent opening and closing movements of the door, the load arm 11 will thereby be synchronized with respect to the two abutment rollers 7 and, accordingly, it will enter a tooth space of the circumferential toothing 14 of the first abutment roller 7 during each opening of the door. Since an oppositely directed relative movement of the two abutment rollers 7 is excluded, the circumferentially toothed sections of the rollers 7 can also not move so as to come out of the area of engagement of the load arm 11 of the torsion bar spring.

Figure 3:
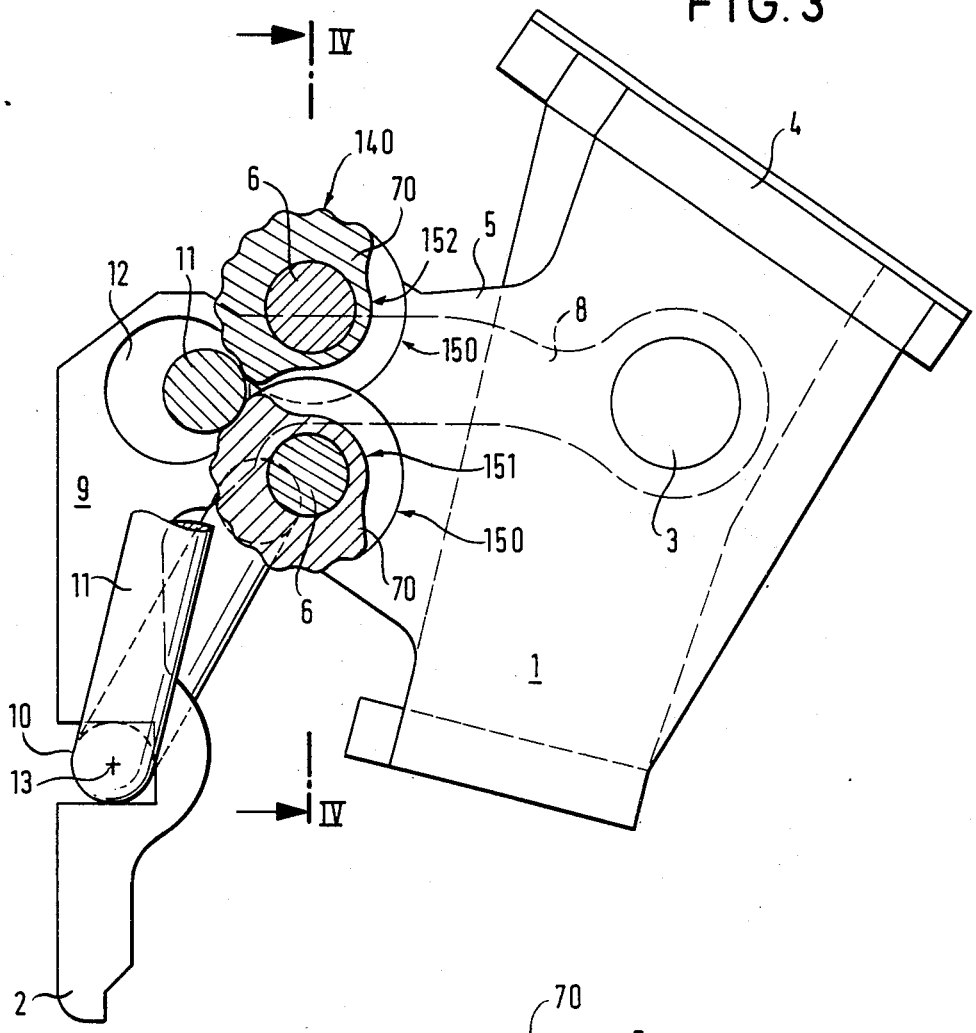
FIG. 3 is a top view of another embodiment of a door hinge assembly in accordance with the invention.
Figure 4:
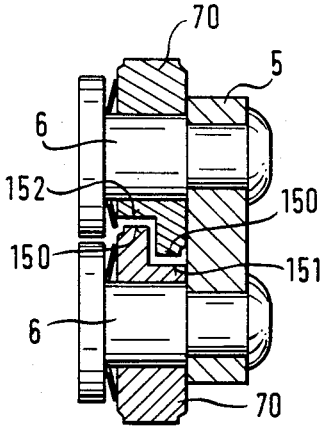
FIG. 4 is a partial sectional view taken along the line IV—IV of FIG. 3.

In the second embodiment of the invention shown in FIGS. 3 and 4, two abutment rollers 70 are provided and, as seen particularly in FIG. 4, the rollers 70 are constructed so as to have oppositely arranged steps in an otherwise identical arrangement and construction of individual parts of the two hinge members as well as of the door fastener. The two abutment rollers 70 each have a section provided continuously over their entire axial length or height with a circumferential toothing 140 and they have a smooth outer circumferential surface 150 which is offset in a stepwise manner wherein the first abutment roller 70 has a lower offset section 151 which has a smaller diameter than its circumferentially toothed circumferential section 150 which is not offset. Conversely, the second abutment roller 70 has an offset, smooth, circumferential section 152 which has a diameter which is equally small relative to the circumferential section 150, like the circumferential section 151 of the first abutment roller 70. The two abutment rollers 70 mesh with one another with their stepwise offset circumferential sections 150 and 152 or 150 and 151, respectively, so that as a whole the axial distance of the bearing axes 6 results which is reduced by the amount of the diameter reduction of the circumferential sections 151 and 152 of the abutment rollers.

While specific embodiments of the invention have been shown and described in detail to illustrate the application of the inventive principles, it will be understood that the invention may be embodied otherwise without departing from such principles.

What is claimed is:

1. A door hinge assembly including a door stop mechanism for a motor vehicle comprising: a first and a second hinge member mounted relative to each other for pivotal motion about a hinge axis to mount a door for swinging movement between an open and a closed position; a torso bar spring supported at one of said hinge members, said torsion bar spring having a load arm projecting over the height of said hinge assembly and directed parallel to said hinge axis; a pair of abutment rollers rotatably mounted at the other of said hinge members at a position spaced from said hinge axis; said abutment rollers being located to be always substantially simultaneously engaged by said load arm of said torso bar spring at a position always between said rollers to form a catch device at least for said open position of said door; each of said abutment rollers being formed to comprise a smaller diameter portion and a larger diameter portion and bearing means rotatably mounting said abutment rollers about fixed respective bearing axes, said bearing axes being spaced a fixed distance from each other, wherein said distance is always smaller than said larger diameter portion of said rollers.

2. An assembly according to claim 1, wherein said abutment rollers include circumferential toothing along said larger diameter portion with said smaller diameter portion being devoid of said circumferential toothing.

3. An assembly according to claim 2 wherein said circumferential toothing is formed with a wave-shaped configuration and is dimensioned so as to be adapted to the diameter of said load arm of said torsion bar spring.

4. An assembly according to claim 2 wherein said abutment rollers are offset in a stepwise manner along their axial height and wherein two of said abutment rollers are provided from top to bottom reciprocally with said circumferential toothing extending over a part of their circumference.

5. An assembly according to claim 4, wherein one of said abutment rollers includes a lower circumferential section of said smaller diameter and, located opposite thereto, an upper circumferential section of said larger diameter portion of the other of said abutment rollers.

6. An assembly according to claim 4 wherein said two abutment rollers have their smaller diameter portions in their respectively offset areas relative to said toothed circumferential sections thereof.

7. An assembly according to claim 2, wherein said toothed circumferential sections of said abutment rollers are arranged in such a way that they block opposite rotational movement of said abutment rollers relative to each other.

8. An assembly according to claim 1, wherein said abutment rollers are formed with said smaller diameter portions extending along half of their circumference, said smaller diameter portion of each roller having a smooth outer surface.

9. An assembly according to claim 1, wherein said abutment rollers are provided with said reduced diameter portions thereof arranged in such a manner that correct positioning of said abutment rollers occurs automatically by engagement of said abutment rollers with said load arm of said torsion bar spring during a single operation of said hinge assembly.

10. An assembly according to claim 1, wherein said abutment rollers have identical diametral dimensions.

11. An assembly according to claim 1, wherein said larger diameter portions operate to engage each other to restrict angular rotation of said rollers relative to each other.

* * * * *